US008734941B2

(12) United States Patent
Qiao

(10) Patent No.: US 8,734,941 B2
(45) Date of Patent: May 27, 2014

(54) USE OF CHEMICAL ADMIXTURES AS PROMOTORS, RECOVERY AGENTS

(76) Inventor: Yu Qiao, Fairlawn, OH (US)

( * ) Notice: Subject to any disclaimer, the term of this patent is extended or adjusted under 35 U.S.C. 154(b) by 2120 days.

(21) Appl. No.: 11/720,784

(22) PCT Filed: Dec. 6, 2005

(86) PCT No.: PCT/US2005/043880

§ 371 (c)(1),
(2), (4) Date: Oct. 6, 2009

(87) PCT Pub. No.: WO2007/044030

PCT Pub. Date: Apr. 19, 2007

(65) Prior Publication Data

US 2010/0016460 A1 Jan. 21, 2010

Related U.S. Application Data

(60) Provisional application No. 60/633,937, filed on Dec. 6, 2004.

(51) Int. Cl.

| | |
|---|---|
| ***F41H 5/02*** | (2006.01) |
| ***F41H 1/00*** | (2006.01) |
| ***E06B 9/00*** | (2006.01) |

(52) U.S. Cl.
USPC ..... 428/320.2; 267/136; 89/36.02; 109/49.5

(58) Field of Classification Search
USPC ..... 267/136, 116, 139; 428/306.6, 304.4, 428/320.2, 411.1; 89/36.02, 36.05, 920, 89/921; 188/268, 269, 371, 374; 60/509, 60/512; 293/132, 107; 2/2.5; 109/49.5
See application file for complete search history.

(56) References Cited

U.S. PATENT DOCUMENTS

| | | | | |
|---|---|---|---|---|
| 6,052,992 | A * | 4/2000 | Eroshenko | 60/509 |
| 6,335,398 | B1 | 1/2002 | Amiya et al. | |
| 6,615,959 | B2 * | 9/2003 | Eroshenko | 188/268 |
| 6,645,569 | B2 | 11/2003 | Cramer et al. | |
| 2008/0020229 | A1 * | 1/2008 | Taya et al. | 428/613 |

* cited by examiner

*Primary Examiner* — Yewebdar Tadesse
(74) *Attorney, Agent, or Firm* — Renner Kenner Greive Bobak Taylor & Weber

(57) ABSTRACT

The present invention is directed to an energy absorption system for absorbing mechanical impact energy using one or more chemicals for promoting absorption of a liquid, and optionally including one or more promoter, recovery agent, and/or viscosity adjusting agent, which allows the system to release the absorbed energy.

41 Claims, 20 Drawing Sheets

USE OF CHEMICAL ADMIXTURES AS PROMOTORS, RECOVERY AGENTS

This application claims priority to U.S. Provisional Patent Application No. 60/633,937, filed on Dec. 6, 2004, which is incorporated herein by reference in its entirety.

The present invention was made in the course of research that was supported by The Army Research Office Grant No. W911NF-05-1-0288. The United States Government may have certain rights to the invention or inventions herein.

FIELD OF THE INVENTION

The present invention relates to energy absorption systems and damping systems for the absorption of mechanical energy and/or the dissipation of impact forces.

BACKGROUND OF THE INVENTION

The growing need for new advanced energy absorbing systems demands materials having increasing energy absorption capacity, and decreasing weight. Such materials find applications in a wide variety of technologies, including military armor, body armor, blast resistant materials, springs, automobile bumpers, protective covers or padding, or in any device that must absorb energy.

Recently, some attention has been focused on applying porous materials to advanced energy absorption systems. In such systems, infiltration pressure, pin, is an important factor governing system performance because the energy absorption mechanism cannot be activated until the applied pressure exceeds the infiltration pressure. Unfortunately, current technology limits researchers to systems based on pure water. Accordingly, infiltration pressure is primarily adjusted using surface treatment techniques and by controlling pore size. As will become clear herein, the present invention overcomes the shortcomings of the prior art.

SUMMARY OF THE INVENTION

In general the present invention provides a method and apparatus for absorption of mechanical energy. The present invention absorbs energy when a mechanical load is applied to a porous material immersed in an infiltration liquid. The load forces the liquid into the nanopores against an unfavorable free energy of wetting and against solid-liquid friction, thus energy is absorbed. Further, chemical promoting agents can optionally be added to assist the infiltration liquid in entering the nanopores. Chemical recovery agents can also optionally be added to enhance the system's ability to expel liquid when the load is removed. Finally, the viscosity of the system can be adjusted by optionally adding chemical compounds referred to herein as viscosity adjustors.

In contrast to the prior art, the present invention removes the need for surface treatments or controlling porosity. It accomplishes this by introducing compounds that promote or suppress the infiltration of liquid into porous materials, thus changing the infiltration pressure. Thus, the present invention enables one to tune infiltration pressure by adjusting the amount of such compounds. In one embodiment, the present invention relates to (1) chemical promoters that render infiltration pressure broadly tunable, (2) chemical recovery agents that significantly improve system recoverability, (3) promoters that do not affect the accessible pore volume, and (4) chemical viscosity adjustors that adjust the system's viscosity.

The present invention also relates to an energy absorption system comprising a porous material in mechanical communication with a means for communicating a compressive load, an infiltration liquid, which is non-wetting to the porous material in the absence of a load, wherein the infiltration liquid is in fluid communication with the pores of the porous material, and the means for communicating a compressive load to the infiltration liquid and porous material so that the infiltration liquid is forced to enter the porous material.

The present invention also relates to a method for absorbing impact energy, comprising providing a porous material, providing an infiltration liquid, which is non-wetting to the porous material in the absence of a load, wherein the infiltration liquid is in fluid communication with the pores of the porous material, providing a means for communicating a compressive load to the infiltration liquid and porous material so that the infiltration liquid is forced to enter the porous material, and impacting the means for communicating a compressive load with a projectile, a self-propelled body, or a shock wave, wherein the impact is capable of actuating the means for communicating a compressive load.

DETAILED DESCRIPTION

As used herein, the term "means for communicating a mechanical" includes all structure that directly or indirectly transfers a mechanical load(s) to an infiltration liquid and/or porous material. Such means include, without limitation, (1) a cavity and piston, wherein the cavity is capable of holding an infiltration liquid and a porous material, and also capable of receiving the piston, (2) a hollow sphere or ellipsoid with a flexible wall, wherein the liquid and porous material can be held therein, and (3) a flexible matrix in which pockets of the liquid and porous material are dispersed.

As used herein, the term "system recoverability" is a measure of the absorbed energy at the end of the i-th (where $i \geq 2$) loading-unloading cycle as compared to that of the first cycle. Thus, recoverability observations are made while the system is relaxed, i.e. is not under a load.

As used herein, the term "promoter" includes chemical compounds and chemical mixtures that decrease infiltration pressure. Promoters generally accomplish this by lowering the solid-liquid interfacial energy. A promoter can be capable of entering substantially all of the pores of a porous material. Alternatively, a promoter can be capable of entering only a portion of the pores. For instance, some relatively large promoters can only enter relatively large pores.

As used herein, the term "recovery agent" includes chemical compounds, and chemical mixtures that assist the energy absorbing system in releasing absorbed energy. In order to be effective, recovery agents need not result in a complete or 100% release of all absorbed energy. Similarly, recovery agents need not result in a complete recovery of the system's original shape.

As used herein, the term "infiltration liquid" includes any liquid chemical compounds, solutions or mixtures that do not wet a given porous material without the application of a force or pressure. Accordingly, appropriate infiltration liquids are determined, in part, by the porous material with which it is combined.

As used herein, the term "porous material" includes any solid or gel having pores, channels, or interconnected void spaces capable of being placed in fluid communication with fluids external to the porous material. Appropriate porous materials are capable of being wetted by (i.e. adsorbing) and capable of being infiltrated by (i.e. absorbing), infiltration liquids under loading conditions. Optionally, porous materials are capable of expelling absorbed infiltration liquids when the load is removed. However, the capacity to expel absorbed infiltration liquids typically, but not necessarily, requires the addition of a recovery agent.

Figure 14:
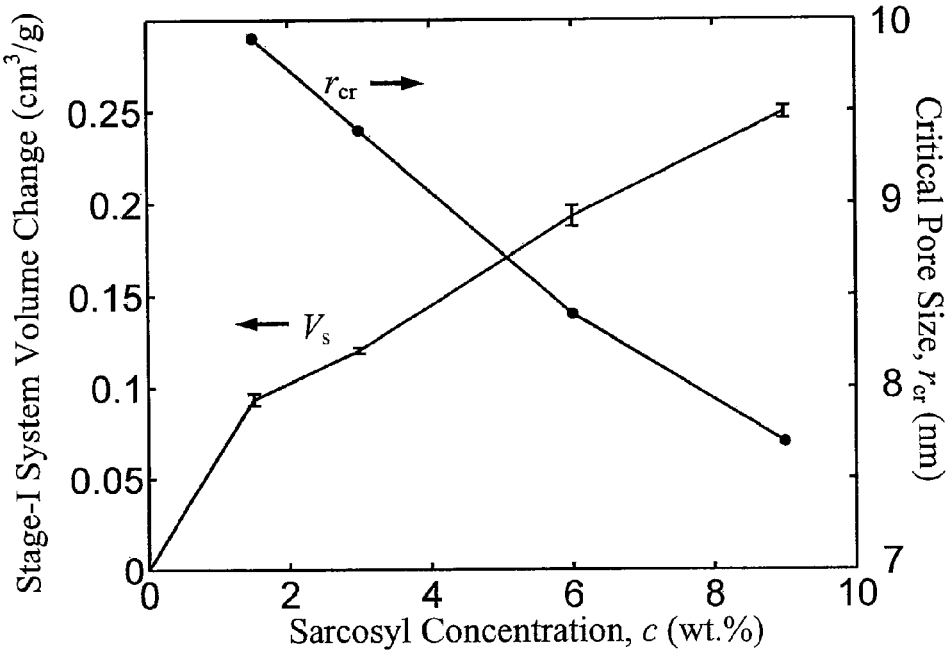
FIG. 14 is a plot showing the effect of a promoter concentration on accessible pore volume and on critical radius.

As used herein, the term "critical radius" refers to a promoter radius that is characterized by being capable of entering pores having a diameter equaling twice the critical radius or more (See FIG. 14). Molecular dynamics simulations suggest that promoters need extra space to enter a pore, even when infiltration is otherwise energetically favorable. Therefore, the critical radius is typically several times larger than the molecular radius. Furthermore, the critical radius is not a material constant, but rather it is dependant on concentration. Specifically, as promoter concentration increases the critical radius decreases. This phenomenon can be described according to the following statistical mechanical theory. At an initial critical radius, $r_{cr,i}$ a probability, $p_i$, describes the likelihood that a promoter molecule will enter a comparably sized pore during a given time interval, $\Delta t$. As promoter concentration increases the probability, $p_f$, of a promoter entering the same pore during $\Delta t$ increases accordingly. Thus, in order for probability to remain constant (i.e. $p_f - p_i = 0$) with increasing promoter concentration, the critical radius must decrease, $r_{cr,f}$. Thus, when $p_f - p_i = 0$, $r_{cr,f} < r_{cr,i}$.

Figure 13:
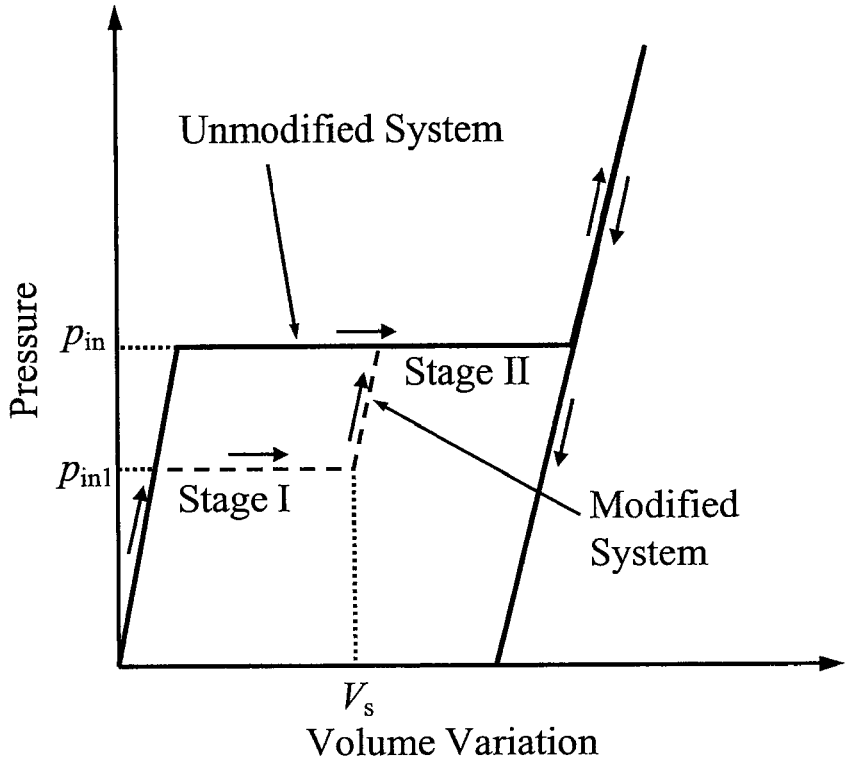
FIG. 13 is a pressure/volume hysteresis loop of an idealized system having a perfectly monodisperse pore size.

As used herein, the term "Stage I" refers to the region of a two-Stage pressure/volume curve or hysteresis loop defining a lower pressure plateau (see FIG. 13). Typically, the lower pressure plateau is attributed to promoter molecules preferentially entering pores having a diameter greater than or equal to twice the critical radius, and substantially not entering smaller pores, which account for the higher pressure plateau.

As used herein, the term "Stage II", refers to the region of a two-Stage pressure volume curve or hysteresis loop defining the higher pressure plateau (see FIG. 13). Typically, the higher pressure plateau is attributed smaller pores, which are substantially incapable of accepting promoters because the diameter of such pores is less than twice the critical radius.

As used herein, the term "Stage boarder" refers to the division between first and second Stages, i.e. Stage I and Stage II, of the pressure/volume curve or hysteresis loop. The Stage boarder can be calculated as the point where the slope of the sorption isotherm equals the average slope of Stages I and II (see FIG. 13).

The present invention generally relates to an energy absorption system for dissipating energy from a mechanical load (e.g. a compressive load), and methods of using the same. More particularly, the invention comprises a porous material, and a liquid that tends not to wet the porous material in the absence of a load. The invention may optionally include a promoter that assists the infiltration liquid in entering the porous material and/or a recovery agent to improve system recoverability. The system's recoverability and the infiltration pressure can be adjusted simultaneously using promoters and/or recovery agents.

In principal, a load is applied to the invention, which forces the infiltration liquid into the porous material against an unfavorable free energy of wetting. When the load is released the system may or may not relax. That is to say, the liquid may either flow out of the pores or remain trapped. Thus, the energy exerted on the invention can itself be entrapped, i.e. absorbed, by the invention. Additionally, internal friction due to the motion of fluids in the nanopores also causes energy dissipation.

More specifically, the invention generally operates as follows. When porous materials, e.g. zeolites or nanoporous silicas, are immersed in one or more infiltration liquids, at atmospheric pressure, $p_{at}$, the liquid cannot enter the nanopores due to an unfavorable free energy of wetting. As the pressure load increases to a critical value, $p_{in}$, pressure-induced infiltration can occur. Conversely, as the pressure is reduced back to $p_{at}$ the confined liquid remains in the nanopores. Such infiltration may or may not require recovery agents to expel substantially all of the infiltration liquid. Since the specific surface area of porous materials is usually in the range of 100-1000 $m^2/g$, their capacity for energy absorption can be much higher than that of shape memory alloys and composite materials.

Figure 1:
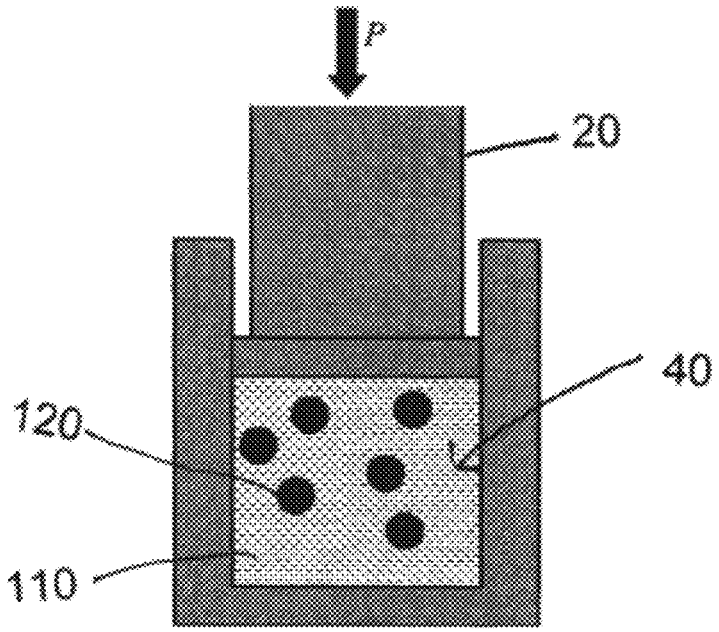
FIG. 1 is a schematic diagram of an embodiment of the energy absorption system of the present invention.
Figure 2:
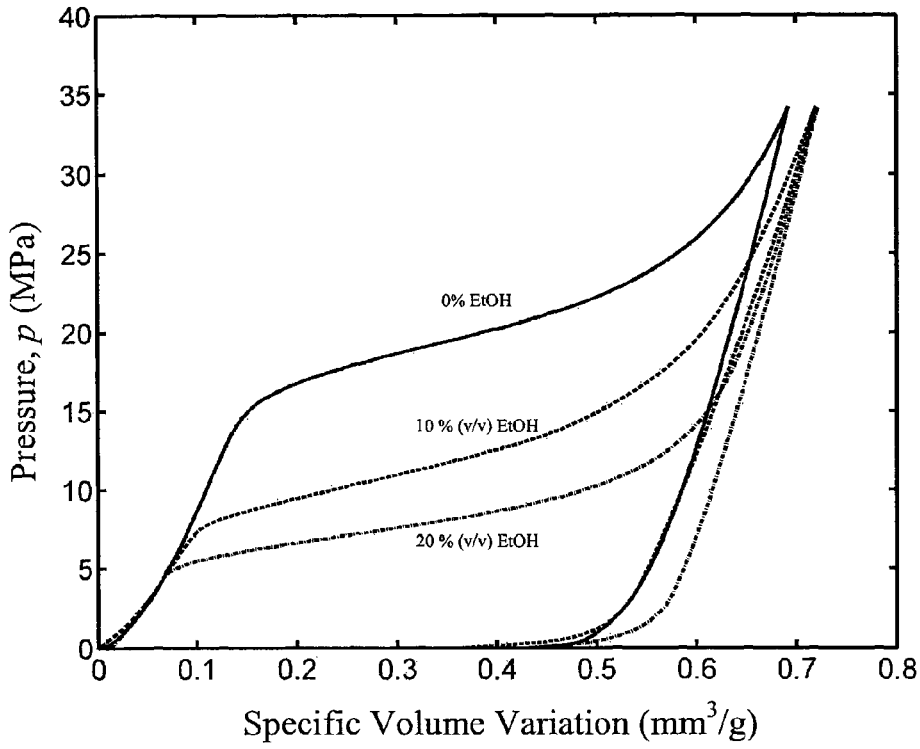
FIG. 2 is a set of hysteresis plots showing the relationship of applied pressure to specific volume as a function of ethanol content.

In one embodiment of the present invention the components are arranged in a compression system 10 comprising a piston 20 and a cavity 40 receiving the piston, wherein the porous material 120 and liquid 110 are located in the cavity 40 (see FIG. 1). The piston 20 bears a load, which exerts a compressive force on the energy-absorbent system 100. This load tends to force the infiltration liquid 110 into the porous material 120, but it is opposed by an unfavorable free energy of wetting. The point at which the load overcomes the unfavorable free energy of wetting is termed the infiltration pressure, $p_{in}$. At the infiltration pressure the liquid 110 enters the porous material 120. The plot in FIG. 2 shows that as compression increases, pressure initially increases rather quickly, and then slows. The region where the pressure increase slows is the region where liquid begins to enter the porous material beginning with the larger pores and gradually including smaller and smaller pores as pressure increases. Due to a variety of physical parameters including a non-uniform pore size, the region is not a well defined point. Rather, it is a pressure plateau. For the sake of simplicity, the infiltration pressure is taken to be the midpoint of the plateau, which is defined as the point equidistant between the two points where the slopes of the isotherm curve are reduced by 50% from that of the proportional section. In systems where substantially all of the pores are accessible to promoter(s), the pressure plateau has a single Stage. Conversely, in systems where only a portion of the pores are accessible to promoter(s) the pressure plateau has two distinguishable Stages. The point at the high pressure edge of the pressure plateau where the pressure begins to rise sharply again is the point at which substantially all of the pores are filled.

Two-Stage Embodiment

In one embodiment of the present invention, the promoter is too large to enter a portion of the pores of a porous material. An aqueous solution is made comprising Sigma 61747 N-Lauroylsarcosine sodium salt (hereinafter sarcosyl). The nanoporous material comprises a Fluka 100 end-capped $C_8$ reversed phase silica, with the average pore size of 7.8 nm and the standard deviation of 2.4 nm. The specific pore volume is $V_0$=0.5 $cm^3$/g and the particle size is in the range of 10-35 μm. The pore surface is covered by a layer of 10-12% hydrophobic silane groups. The chemical formula of sarcosyl is $CH_3(CH_2)_{10}CON(CH_3)CH_2COONa$. Its molecular weight is 293.39 g/mol and its molecule size is about 1.8 nm. It is energetically favorable for the sarcosyl molecules to attach the pore surface. Additionally, sarcosyl hydrogen bonds with water molecules.

There are two possible mechanisms of the modified infiltration: (a) homogeneous infiltration, in which the sarcosyl molecules enter the nanopores simultaneously with the water molecules, i.e. the sarcosyl molecules act as "carriers" bringing the water into the nanoenvironment; and (b) heterogeneous infiltration, where the sarcosyl molecules enter the nanopores first and form a solid-liquid interface layer, so that the pore walls become effectively wetting to water.

Figure 15:
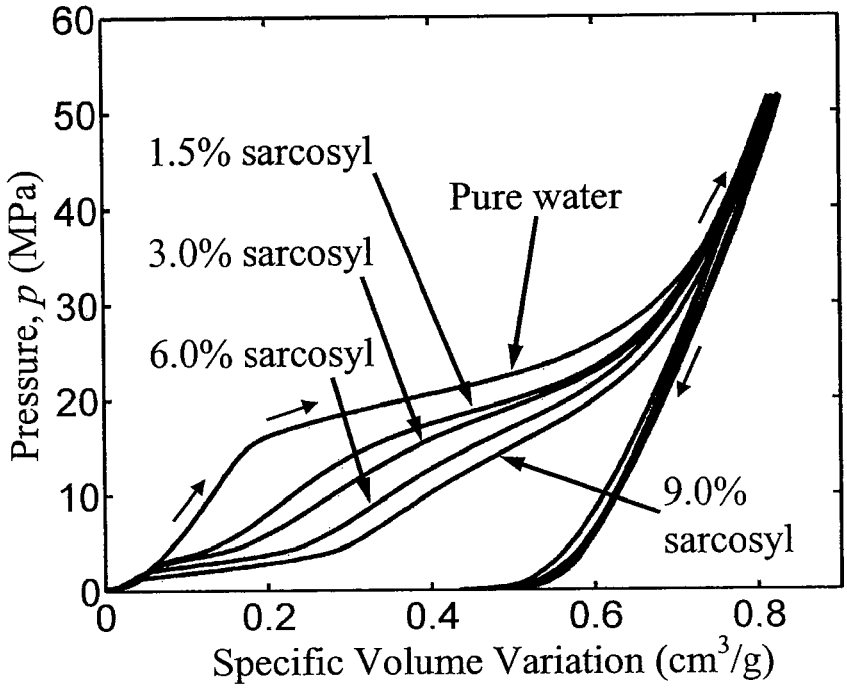
FIG. 15 is a pressure/volume hysteresis loop of a series of sarcosyl embodiments.
Figure 16:
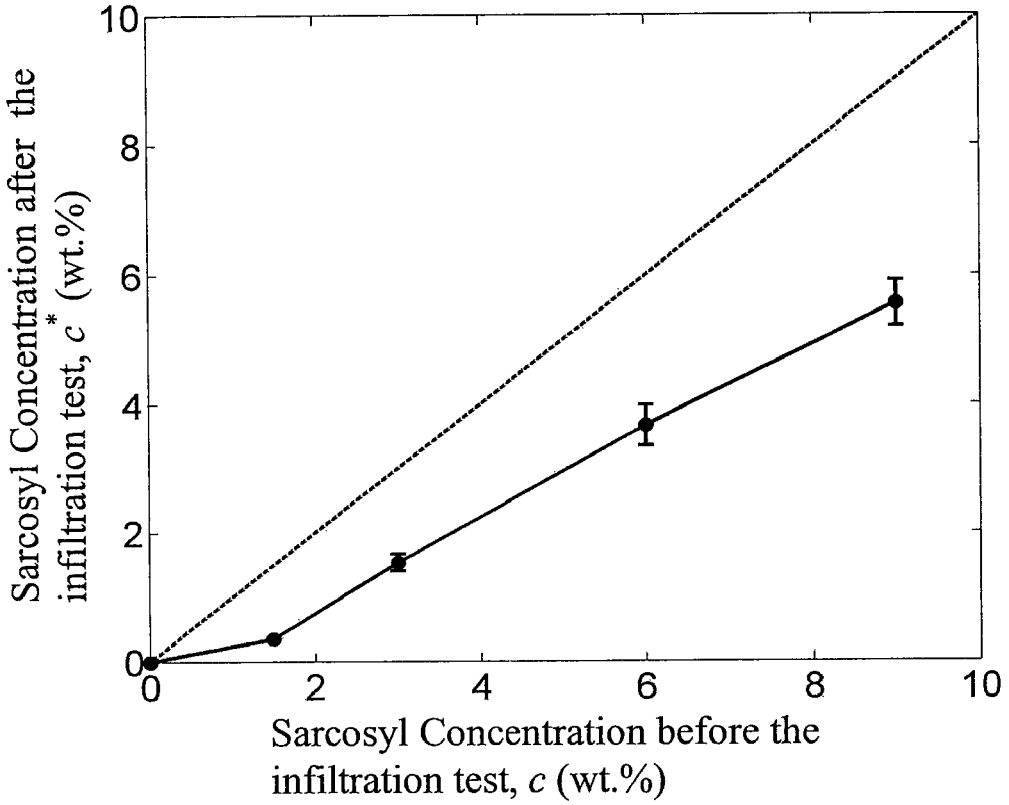
FIG. 16 is a plot comparing the concentration of a promoter before and after infiltration.

Infiltration is induced using a model 5569 Instron machine. Each sample comprises 0.5 g of nanoporous silica particles immersed in 7 g of an aqueous solution of sarcosyl, with the initial sarcosyl concentration, c, ranging from 0-9.0 wt %. The system is sealed in a stainless steel cavity 40. A piston is compressed into the container at a rate of 1 mm/min. As the pressure exceeds a critical value, pressure-induced infiltration occurs and the effective bulk modulus of the system decreases considerably, resulting in the formation of an infiltration plateau, as shown in FIG. 15. Infiltration begins first in relatively large pores. Smaller pores become involved as pressure increases. Eventually, substantially all of the porous space is filled. When the pressure reaches about 50 MPa, the piston is reversed at the same rate, i.e. 1 mm/min. During unloading, the "outflow" of confined liquid is difficult, due to gas phase nucleation. The load applied to the piston 20 is measured with an Instron 50KN loadcell. The pressure is also calculated as $p=P/A_0$, where $A_0$=286 $mm_2$ is the cross-sectional area of the piston. After the infiltration experiment, the filled silica particles are removed by an ASTM 40-60 filter, and the liquid phase is analyzed by ultraviolet absorption to determine the sarcosyl concentration, c*. The results are shown in FIG. 16.

Figure 17:
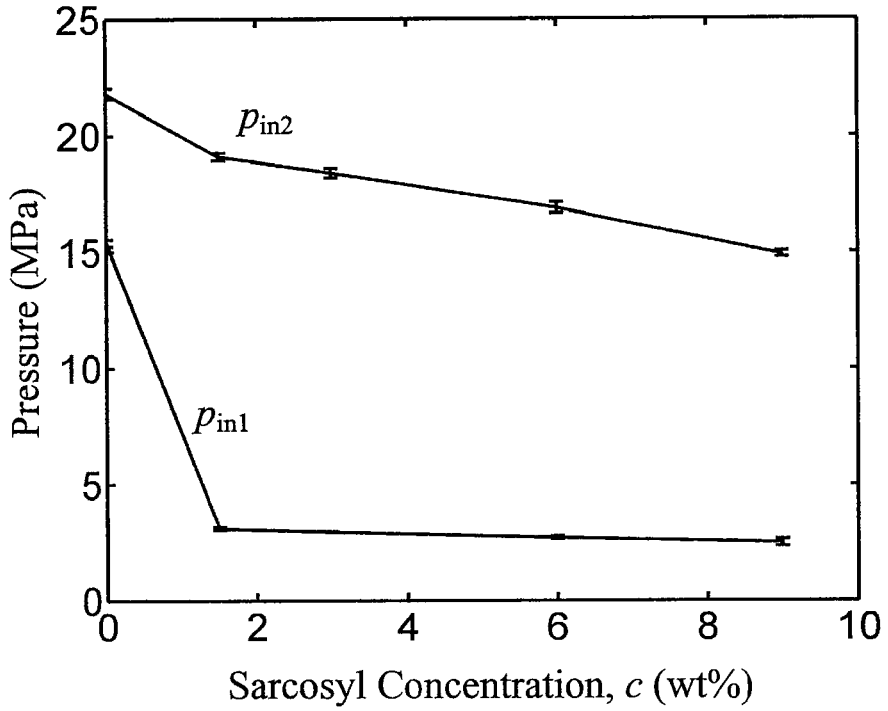
FIG. 17 is a plot comparing the effect of promoter concentration on the infiltration pressures of a first and second Stage.

As shown in FIG. 15 addition of sarcosyl has an considerable effect on the low pressure end of the sorption isotherm, while having comparatively little effect on the higher pressure end of the isotherm. Thus, the isotherm is two-Staged. The pressure in Stage I is lower, indicating that it is difficult for the sarcosyl molecules to enter the small pores. As the sarcosyl concentration increases, both the Stage I infiltration pressure, $p_{in1}$, and the Stage II infiltration pressure, $p_{in2}$, are lowered. This effect is illustrated in FIG. 17, where the infiltration pressure is defined as the pressure at the middle point of each Stage. The $p_{in1}$ of the system containing pure water is taken to be the pressure at the onset of infiltration. The Stage border is taken to be the point where the slope of sorption isotherm equals the average slope of the other two Stages.

The c dependence of $p_{in1}$ suggests that, at the onset of infiltration, the homogeneous mode is dominant. This is because once the heterogeneous sarcosyl-rich interface zone is formed, further variation in sarcosyl concentration should not affect the infiltration pressure. FIG. 16 indicates that the sarcosyl concentration in the liquid phase decreases after the infiltration tests, i.e. the sarcosyl content inside the nanopores must be higher than outside. This phenomenon can be attributed to the formation of an interface layer of promoter molecules at the pore walls. Thus, after the onset of infiltration of sarcosyl and water molecules, their distributions are non-uniform.

Note that the decrease in sarcosyl content outside the nanopores is dependent on the initial sarcosyl concentration, which is probably caused by the increase in Stage-I infiltration volume, $V_s$. FIG. 14 illustrates the influence of promoter concentration, c, on $V_s$, which is the specific volume of the larger pores, which can be infiltrated by sarcosyl molecules. If we assume that the pore size follows a normal distribution function, the $V_s/V_0$ ratio can be related to the critical radius between Stages I and II, $r_{cr}$, as shown in FIG. 14. The value of $r_{cr}$ is much larger than the molecular size of sarcosyl. This is in agreement with the molecular dynamics simulation result that, even when a nanoenvironment is nominally energetically favorable, the repelling effect is significant unless the pore size is several times larger than the molecular size. That is, a sarcosyl molecule needs a "free volume" to enter the pore. It is remarkable that $r_{cr}$ is not a material constant. Rather, it is highly dependent on the sarcosyl concentration. As c increases from 1.5 to 9.0 wt %, $r_{cr}$ decreases from 9.9 nm to 7.7 nm. Accordingly, the free volume is reduced by a factor of 2. The relationship between $r_{cr}$ and c is quite linear.

In summary, the addition of some high-molecular weight promoters causes the sorption isotherm of some systems to become two-Staged. Both the Stage-specific infiltration pressure and infiltration volume vary with sarcosyl concentration. This is caused by the difficulty of sarcosyl molecules entering relatively small pores. The critical radius of infiltration is much larger than the radius of the sarcosyl molecule, suggesting that extra space, i.e. free volume, is required in order for the promoter to enter a pore. The size of the free volume is dependent on the promoter concentration, and the $r_{cr}$-c relation is nearly linear.

Sorption Behaviors of the Porous Material

When the nanoporous particles are immersed in a mixture of infiltration liquid and promoter one of two absorption effects could occur. The first is selective absorption, wherein promoter molecules are preferentially absorbed by the nanopores. Selective absorption phenomena has been observed repeatedly in catalysis and purification processes. If it were to occur in this case, then the promoter would fail to promote water infiltration. The second possibility is that both promoter and liquid are absorbed simultaneously. The second option describes the present invention.

Figure 6:
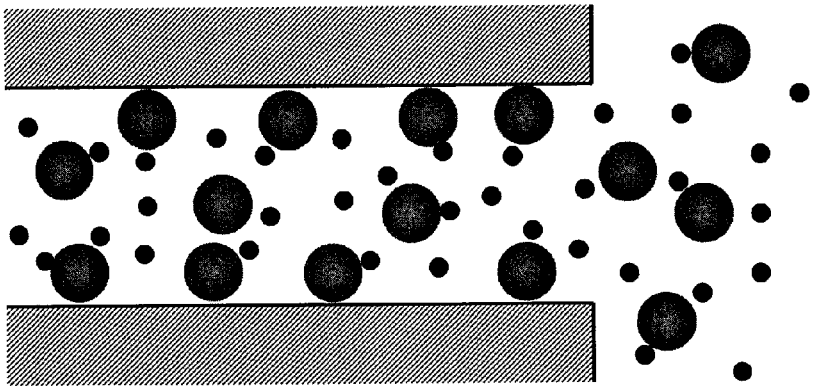
FIG. 6 is a drawing showing the distribution of infiltration liquid and promoters in a nanopore.

Although both the infiltration liquid and the promoter are absorbed, it does not necessarily follow that the composition of the solution in the pores is the same as that of the bulk solution. However, comparison of solution densities before and after infiltration resolves this question. Following infiltration testing, the supernatant is sampled and filtered through an ASTM 40-60 filter to remove silica particles. Then, a sample of the filtrate is volumetrically transferred to a weighing vessel and weighed. The densities of the liquid before ($\rho_0$) and after ($\rho_1$) infiltration are compared, and the difference is within ±1% for each water/ethanol composition. Accordingly, there is essentially no detectable change in density and therefore composition, as a result of infiltration. Therefore, the water to ethanol ratio in the pores is very similar to that of the bulk solution, as shown in FIG. 6.

Since the solid-water interfacial energy is higher than the surface tension of water, the density of water molecule in the interfacial zone tends to be lower than that in the interior. On the other hand, the ethanol is wetting to the pore wall and thus the density of ethanol molecules in the interface zone is higher, which tends to draw in more water molecules due to the relatively strong ethanol-water bonding. The experimental data showing the weight densities of liquid phases indicate that the effects of these two mechanisms offset each other, thus the average density is similar to that of the bulk solution.

The expulsion of liquid from a nanopore under reduced pressure can be thought of in terms of gas phase nucleation and growth. The formation of a gas phase nucleus leads to a decrease in the free energy of the system by reducing the liquid-solid interfacial energy. However, it also increases the free energy of the system due to the formation of new gas-liquid interfaces, the intrinsic nucleation energy barrier, and the external work. Thus, only gas phase nuclei larger than a critical value are stable and can grow, and this critical value depends on pore size. If such nuclei are present then their growth eventually results in the expulsion of liquid from the porous material. Alternatively, if such nuclei are not present, then any smaller nuclei that may form will vanish, resulting in the liquid being retained within the nanopores.

Recovery agents can make gas phase nucleation and growth easier by either lowering the energy barriers or increasing the excess solid-liquid interfacial tension, or both. Thereby the system can recover before the applied pressure is reduced to 0. Additionally, phase segregation, which can be caused by the recovery agents, can also change the system's desorption behavior.

Components of the Present Invention

Infiltration liquids within the scope of the present invention include, without limitation, water, alcohols, polyols, various relatively polar organic solvents, and liquid metals. More particularly, alcohols within the scope of the present invention include, without limitation, ethanol, propanols, butanols, pentanols, hexanols, and heptanols and mixtures thereof. Polyols within the scope of the present invention include, without limitation, glycerin, ethylene glycol, propylene glycol, mineral oils and mixtures and copolymers thereof. Organic solvents within the scope of the present invention include, without limitation, tetrahydrofuran, dimethyl sulfoxide, dimethylformamide and the like. Liquid metals within the scope of the present invention include, without limitation, mercury, lithium, gallium, tin/lead-lithium, and the like.

The promoter generally has the following characteristics: (1) the promoter molecules are either much smaller than the pore size of the porous material such that repulsion from the pore is negligible, or they are large enough to enter only a portion of the pores while being excluded from smaller pores; (2) the promoter molecules are able to form bonds with the liquid molecules; and (3) it is energetically favorable for the promoter molecules to enter nanopores that are large enough to accept the promoter. There are two equally plausible ways of conceptualizing the action of the promoter: (1) the promoter acts as a "carrier" molecule where the infiltration liquid piggybacks on the promoter, and (2) a surface modification mechanism where the promoter adsorbs to the surface of the nanopore with its more nonpolar portion facing the nonpolar pore wall, and its more polar portion facing the polar infiltration liquid. Based on these criteria, ethanol is an example of a promoter molecule. Other promoters within the scope of the present invention include, without limitation, methanol, propanols, butanols, pentanols, hexanols, and heptanols. Still further promoters within the scope of the present invention include, without limitation, lignosulfonates and hydroxylcarboxylic acids and salts, carbohydrates, sulfates, chloride acid, and organic and inorganic salts thereof.

In one embodiment, larger molecular weight promoters can be used wherein the size of such promoters excludes them from a portion of the pores in the porous material. Accordingly such promoters can selectively adjust the system performance only in pores that are large enough to accept them. FIG. 13 illustrates this effect using an idealized two-Stage system. The smaller pores are substantially less affected or wholly unaffected by such larger molecular weight (i.e. larger sized) promoters. Quantitatively, the effect is to adjust the infiltration pressure non-uniformly across the infiltration plateau. Meaning, the promoter affects the lower end of infiltration plateau, i.e. the larger pores, much more than the higher end, i.e. smaller pores. Graphically, the effect is to break the infiltration pressure curve into two Stages. In Stage I, pores equaling the critical radius or larger accept promoter molecules. Thus, the pores in this range are promoted, and the infiltration pressure drops. The second Stage comprises pores that are smaller than the critical radius. These pores are too small to accept promoter molecules. Thus, they are substantially unpromoted, meaning the infiltration pressure of Stage II is substantially unaffected by the promoter. Such systems are useful in programmable damping.

Compounds that can be cross-classified as both promoters and recovery agents within the scope of the present invention include, without limitation, surfactants such as soaps and alkylammonium compounds, alkali metals, alkaline earth metals, organic and inorganic ammoniums, alkylammonium-carboxylates, sarcosinates, sulfonates, and sulfates; alkyl alcohols, fats, fatty acids, fatty acid amides; and oils including tallow or coconut, palm, castor, olive, or citrus oils; alkylammonium salts of alcohols, sulfates, and of fatty acids; alkoxylated and polyalkoxylated compounds; ethoxylated and polyethoxylated alkylphenols; alcohols, polyols, carboxylic acids, alkylaryl polyethylene glycols, copolymers containing ethylene oxide and silicone surfactants; fatty acid esters, ethers, and their derivatives, cetyldimethylethylammonium bromide, quaternary amines, sulphonic or monoesterified sulphuric acids, benzildimethylalkylammonium chloride, as well as inorganic acids, alkali, and salts.

The porous material of the present invention can be end-capped $C_8$ reversed phase nanoporous particles, having a particle size in the range of 15-35 μm, a surface coverage around 10-12%, and an average pore size of 7.8 nm. According to the results of Barrett-Joyner-Halenda (BJH) testing, the specific area and pore volume of a porous material consistent with this description are 287 $m^2/g$ and 0.55 $cm^3/g$, respectively.

Other suitable porous materials include, but are not limited to, natural nanoporous materials such as diatoms, and radiolarii, abalone shell. Other porous materials within the scope of the present invention include, without limitation, zeolites and zeolite-like materials, nanoporous carbons, carbon nanotubes, nanoporous transition metal oxides such as titanias, aluminas, metal sulfides such as CdS and ZnS, aluminum phosphates, gold, and nanoporous polymers such as polyurethane and polypyrrole, and the like. Still further suitable porous materials include, without limitation, Kaolins, Serpentines, Smectites, Glauconite, Chlorites, Vermiculites, Attapulgite, Sepiolite, Allophane and Imogolite. Furthermore, any porous materials within the scope of the present invention can be used in any appropriate combination thereof.

Illustrative Embodiments

Embodiments without Recovery Agents

Several embodiments of the present invention are illustrated by FIG. 2. Silica comprises the porous material, water comprises the infiltration liquid, and ethanol comprise the promoter. In the absence of ethanol (i.e. c=0), the pressure response is quite linear at low pressures. In this region, the relationship between pressure and volume is dominated by the bulk modulus of the porous particle-liquid system, $K_0$. As the pressure rises to about 17 MPa, water starts to enter the relatively large pores, and as a result the compressibility of the system increases significantly. With increasing pressure, the smaller pores become involved in the infiltration process. When p reaches about 30 MPa, most of the porous space is filled and the effective bulk modulus again becomes essentially that of the low-pressure Stage, $K_0$.

Figure 3:
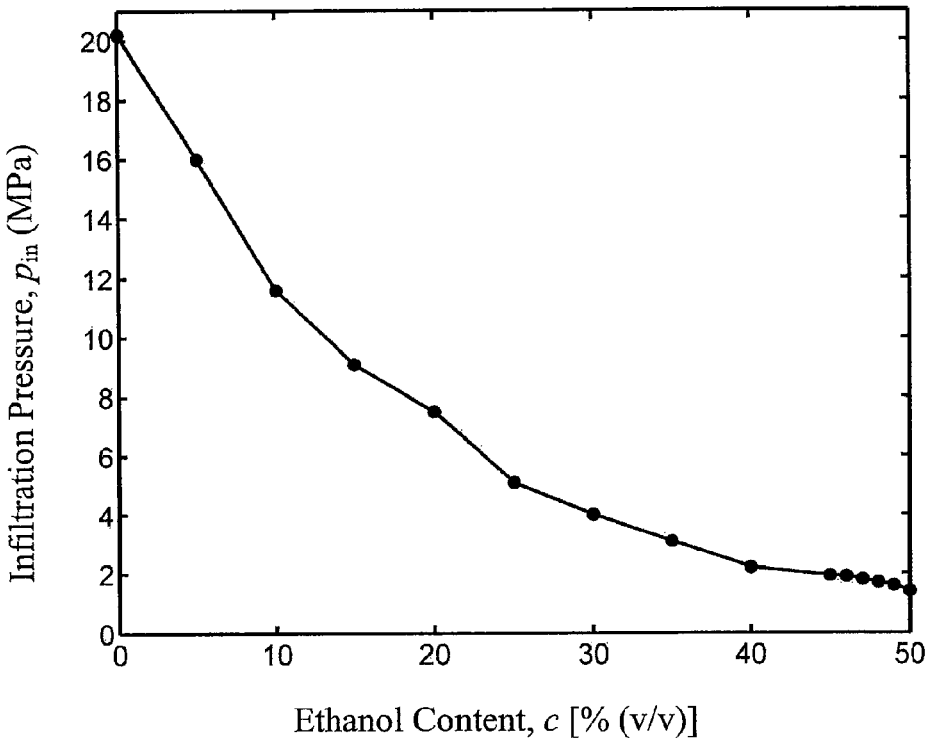
FIG. 3 is a plot showing infiltration pressure as a function of the ethanol content.

As the ethanol content increases, it can be seen that there is a consistent decrease in the infiltration pressure, which is shown in FIG. 3 more clearly, indicating that adding ethanol can promote water infiltration. However, the width of the plateau region is relatively insensitive to the change in c. In each measurement, the change in specific volume, which is associated with infiltration, is around 0.55 $cm^3/g$. This value is close to the BJH testing result. Therefore, the accessibility of the pore surfaces is not affected by addition of ethanol.

According to FIG. 3, the relationship between the infiltration pressure and the ethanol content is nonlinear. This observation is at odds with predictions according to conventional interfacial theories, which apply to macroscopic cases. The nonlinear phenomenon observed here demonstrates that the structure of the interfacial zone in the nanopores is different from that of the macroscopic case due to the confinement effect of the pore walls.

In the absence of recovery agents, most of the porous space remains occupied with liquid after the first loading-unloading cycle, thus the energy absorption ability of the invention is lost. By adding a recovery agent, most of the liquid can be expelled while the system is below the infiltration pressure, but above atmospheric pressure. Thus, a system incorporating recovery agents can be used repeatedly without losing as much energy absorption capacity.

Embodiments With Recovery Agents

Figure 4A:
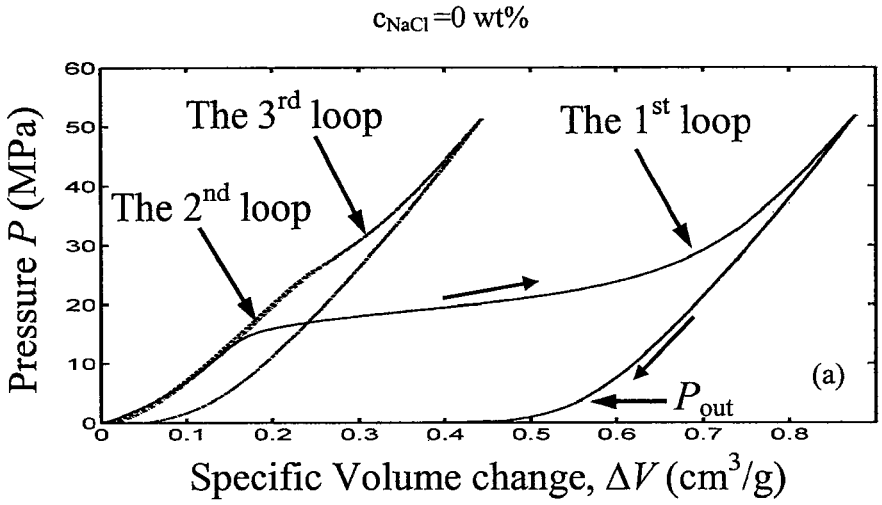
FIGS. 4*a* and 4*b* are comparative plots demonstrating improvements the system recoverability using NaCl: (a) $C_{NaCl}$=0; (b) $C_{NaCl}$=23.1 wt. %.
Figure 4B:
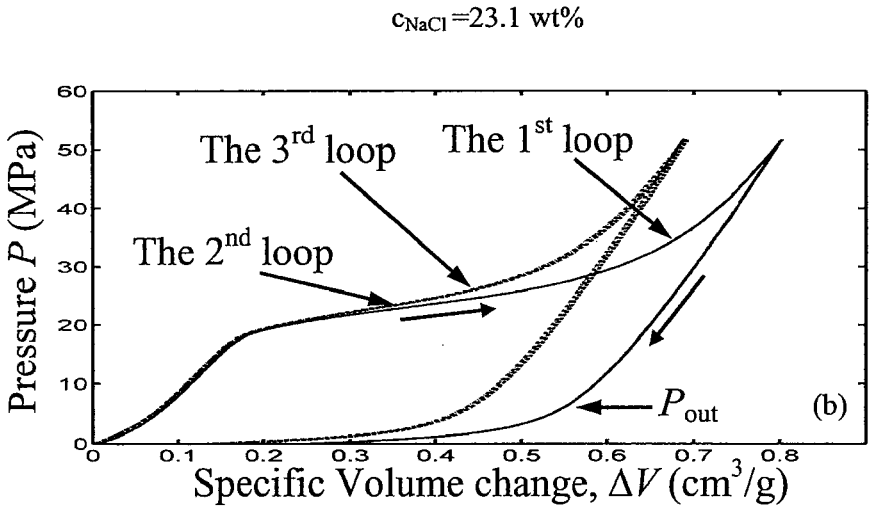

Several embodiments of the present invention are illustrated by FIG. 4. Silica comprises the porous material, water comprises the infiltration liquid, and sodium chloride comprises the recovery agent. In the absence of sodium chloride (i.e. $C_{NaCl}=0$), as shown in FIG. 4(*a*), after the first loading-unloading cycle, the energy absorption capacity of the invention is reduced to nearly zero, due to the fact that most of the porous space remains occupied by the liquid. However, adding NaCl (23.1 wt %), as shown in FIG. 4(*b*), the energy absorption capacity does not diminish as much from the first loading-unloading cycle, and the energy absorption capacity in subsequent cycles diminishes only slightly. This indicates that most of the liquid flows out the nanopores when the pressure is released.

Figure 5:
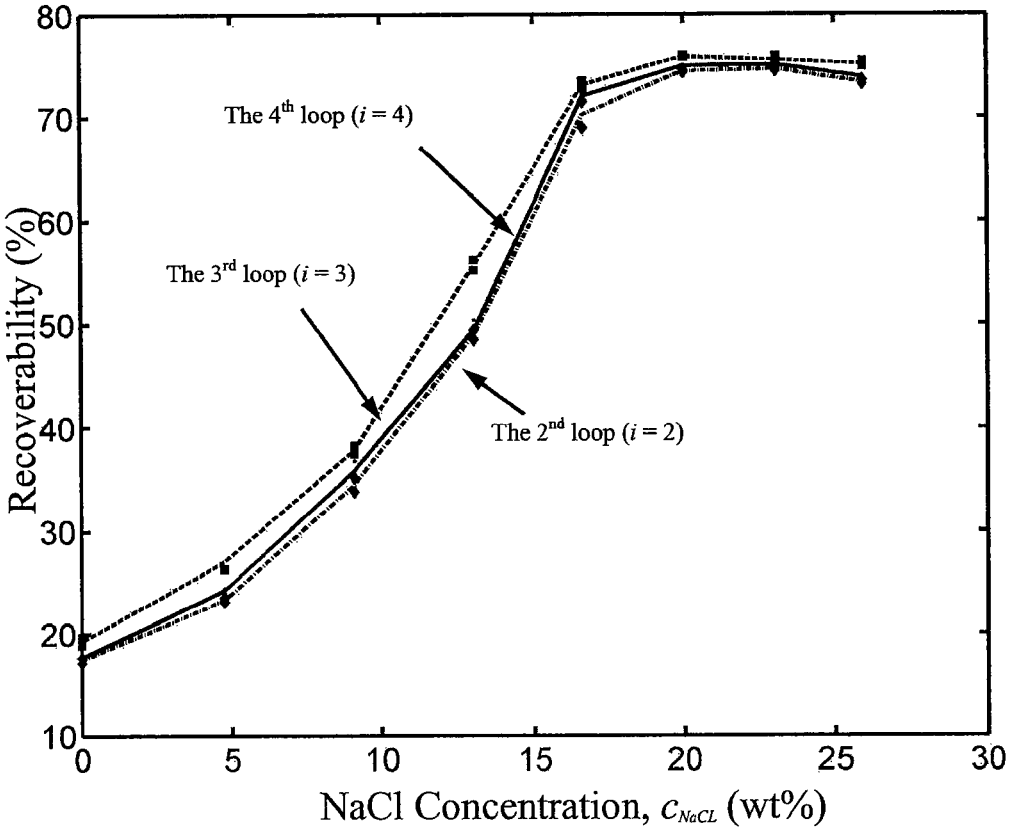
FIG. 5 is a plot showing system recoverability as a function of NaCl content, $C_{NaCl}$.

FIG. 5 illustrates that once the NaCl content, $C_{NaCl}$, exceeded about 17 wt % the system recoverability stabilizes at about 75%.

Illustrative Embodiments Having Promoters

In each of the following embodiments the measurements are carried out using a model 5560 Instron machine in displacement control mode. The crosshead speed is set to 1 mm/min. The pressure is calculated as $p=P/A_0$, where $A_0=286\ mm^2$ is the cross-sectional area of the container. The specific volume change is defined as the ratio of the volume variation to the amount of silica particles. When c is higher than about 50%, infiltration occurs spontaneously at atmospheric pressure. When c is relatively low, the infiltration pressure is positive. As stated previously, the value of $p_{in}$ is taken as the pressure at the midpoint of the infiltration plateau in the load-volume curve. The results of $p_{in}$ are shown in FIG. 3 as a function of c.

In one embodiment nanoporous silica particles are immersed in distilled water, and sealed in a compression system 10 depicted in FIG. 1. The volume fraction, c, of ethanol in the liquid is about 0%. As the load, P, increases, the piston 20 is compressed into the cavity 40 and at a critical pressure, $p_{in}$, forced infiltration occurs, which in this case is at about 20 MPa. As the load is reduced back to zero, the lack of outflow of the confined liquid leads to a significant hysteresis loop in the load-volume curve, as shown in FIG. 2.

In another embodiment of the present invention nanoporous silica particles are immersed in a mixture of Pharmco 95% ethanol and distilled water and subjected to the same infiltration test as in the previous embodiment. The volume fraction of ethanol, c, is about 5%. This results in an infiltration pressure of about 16 MPa. Further embodiments are shown in the table below. Each of these are substantially similar to the foregoing embodiment, except that volume fraction of ethanol varies resulting in variations in infiltration pressure.

| c (v/v) | $p_{in}$ (MPa) |
|---|---|
| 5 | 16 |
| 10 | 12 |

-continued

| c (v/v) | $p_{in}$ (MPa) |
|---|---|
| 15 | 9 |
| 20 | 8 |
| 25 | 5 |
| 30 | 4 |
| 35 | 3 |
| 40 | 2.5 |
| 45 | 2 |

In still other embodiments of the present invention nanoporous silica particles are immersed in a mixture of Pharmco 95% ethanol and distilled water and subjected to the same infiltration test as in the previous embodiment. The volume fraction of ethanol, c, is about 46, 47, 48, 49, and 50% respectively. This results in infiltration pressures as shown in FIG. 3.

Illustrative Embodiments Having Recovery Agents

When the NaCl content, $C_{NaCl}$, is higher than about 17 wt %, the absorbed energy in the i-th loading-unloading cycle (i≥2) is improved by about 75% relative to the first cycle. When $C_{NaCl}$ is relatively low, this ratio is only about 25%. The transition of the system recoverability occurs in the range of $C_{NaCl}$ from about 7 wt % to about 17 wt %. A plot of system recoverability as a function of $C_{NaCl}$ is shown in FIG. 5.

In one embodiment nanoporous silica particles are immersed in distilled water, and sealed in the compression system 10 depicted in FIG. 1. The weight fraction, $C_{NaCl}$, of NaCl in the liquid was about 0%. As the load, P, increases, the piston 20 is compressed into the cavity 40, and then the load is reduced back to P=0. The loading-unloading cycle is repeated several times until the system behavior converges to a steady state, as shown in FIG. 4(*a*). The ratio of the absorbed energy in the i-th cycle to that in the first cycle is about 20%. Embodiments having a variety of $C_{NaCl}$ values are shown in the table below. In each case the measurement is carried out in substantially the same manner as set forth in this paragraph. A plot of these results can also be seen in FIG. 5.

| $C_{NaCl}$ (Wt %) | Recoverability (%) |
|---|---|
| 0 | 20 |
| 5 | 22 |
| 9 | 33 |
| 14 | 50 |
| 17 | 70 |
| 20 | 75 |
| 23 | 75 |
| 26 | 75 |

In still another embodiment of the present invention the foregoing porous materials are immersed in a solution of a recovery agent selected from methanol, benzene, sulfate acids and salts, chloride acids and salts, and the like and subjected to the same infiltration method as set forth in the previous embodiments.

In still another embodiment of the present invention zeolites and zeolite-like materials, nanoporous carbons, aluminas, Kaolins, Serpentines, Smectites, Glauconite, Chlorites, Vermiculites, Attapulgite, Sepiolite, Allophane and Imogolite can be used as the porous material, immersed in the foregoing mixtures of infiltration liquids, promoters, and recovery agents and subjected to the same infiltration method as set forth in the previous embodiments.

Illustrative Embodiments Having Viscosity Adjusting Compounds

In one embodiment of the present invention, glycerin is used to adjust the viscosity of the infiltration liquid. The system comprises 0.5 g of Fluka 100 $C_8$ reversed phase silica particles, with the average pore size of 7.8 nm. The specific pore volume is about 0.5 $cm^3/g$. The silica particles are immersed in a mixture of distilled water and glycerin. The glycerin content varies from about 0% to about 100 wt %. Note that when the glycerin content is 0, the system is substantially pure water, and when the glycerin content is 100%, the system is substantially pure glycerin. The silica particles and the liquid(s) are sealed in a steel cavity 40 similar with that discussed above, and through similar a testing procedure, the sorption isotherm curves are obtained. Infiltration pressure decreases as the glycerin content increases. This result indicates that, glycerin, as well as other viscous liquids can be used to adjust the viscosity of the liquid phase, which is important to simultaneously achieving shear thickening and pressure-induced infiltration. Importantly, the viscous liquid concentration can be 100%. This means the system does not need to contain water. Such systems are compatible with all of the promoter and/or recovery agents enumerated herein.

Figure 18:
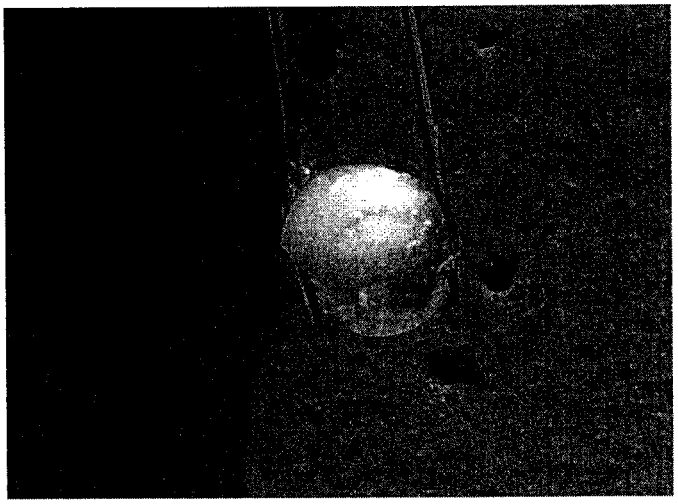
FIG. 18 is a solid-like nanoporous energy absorption and damping system modified with polyacrylic acid.
Figure 19:
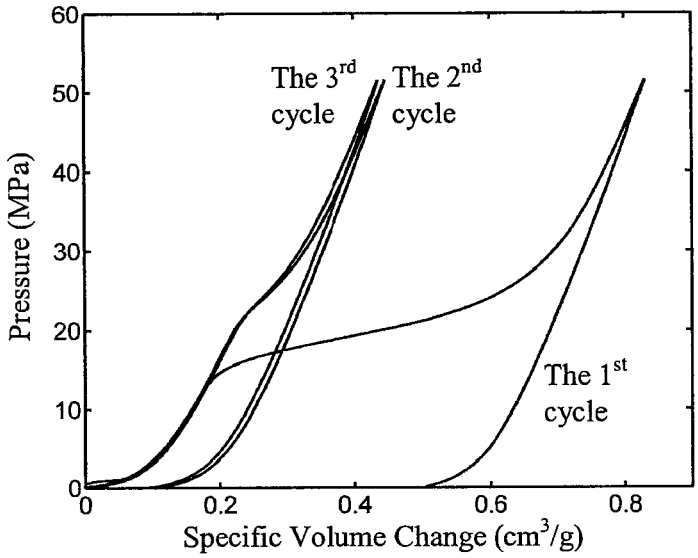
FIG. 19 is a sorption isotherm of the semi-solid nanoporous energy absorption and damping system of FIG. 18.

In another embodiment, adding polyacrylic acid sodium salt converts the liquid phase to a solid-like soft matter. The system comprises 0.5 g of Fluka 100 $C_8$ reversed phase silica particles immersed in 7 g of water. Two percent by weight of Polyacrylic acid sodium salt is added to the liquid phase. After a few seconds, the liquid becomes solid-like (see FIG. 18). The solid-like system is placed in a steel cavity 40 and tested through the same procedure as described above. The results are shown in FIG. 19, which illustrates that the sorption isotherm of the modified system is comparable to that of the unmodified system. In some cases, system recoverability even becomes better. Such semi-solid embodiments may be more amenable to some industrial applications than liquid embodiments.

Figure 20:
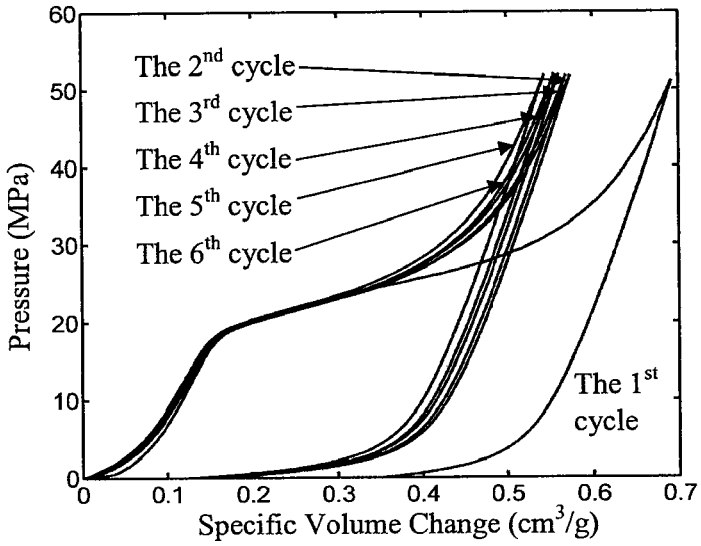
FIG. 20 is a sorption isotherm of the semi-solid nanoporous energy absorption and damping system similar to that of FIG. 19, but replacing polyacrylic acid with $MgSO_4$.

Additionally, saturated $MgSO_4$ can be used to convert the liquid phase to semi-solid without losing the energy absorption capacity. An embodiment is similar to the polyacrylic acid embodiment except that polyacrylic acid is replaced with magnesium sulfate. The $MgSO_4$ concentration is 30 wt %. Initially the system is liquid-like. After mixing for three minutes, the system is allowed to stand in a sealed container at room temperature for three days. A crystal layer forms at the bottom of the bottle during this time. The remaining liquid is removed and the semi-solid system is tested using the same method as that of polyacrylic acid. The results are shown in FIG. 20. As shown, system recoverability is much better than that of an unmodified system. Furthermore, the semi-solid consistency makes sealing much easier.

Suitable viscosity adjusting additives include, without limitation, polyelectrolytes such as poly(acrylic acid) and its salts, poly(2-acrylamido-2-methyl-1-propanesulfonic) acid, poly(2-acrylamido-2-methyl-1-propanesulfonic acid-co-acrylonitrile), poly(2-acrylamido-2-methyl-1-propanesulfonic acid-co-styrene), poly(anetholesulfonic acid) and its salts, poly(sodium 4-styrenesulfonate), poly(styrene-alt-maleic acid) and its salts; poly(4-styrenesulfonic acid) and its salts, poly(vinyl sulfate) salts, poly(vinylsulfonic acid, sodium salt), quaternized poly(2-vinylpyridines), 4-styrenesulfonic acid salt hydrates, diallyldimethylammonium chloride, poly(acrylamide-co-diallyldimethylammonium chloride), poly(allylamine hydrochloride), poly (diallyldimethylammonium chloride), manganese hexafluoroacetylacetonate trihydrate, water absorbing resins, and their copolymers and salts. Additionally, such additives include, without limitation, super-absorbents and materials that can contain a large amount of water or other liquids, e.g. poly(acrylic acid-co-acrylamide) and its salts, poly(acrylic acid) salt-graft-poly(ethylene oxide), poly(2-hydroxyethyl methacrylate), poly(2-hydroxypropyl methacrylate), poly (isobutylene-co-maleic acid), and their salts and copolymers. Viscosity adjusting additives also include, without limitation, materials that can contain a large amount of water such as boric acid and salts, chloride salts, sulfate salts, and other acids, salts, and alkali; sponge-like materials such as sponges and foams, cotton, textiles, composites etc.; and viscous liquids such as glycerin, glycol, molten salts, and the like.

Illustrative Embodiments Having Alternative Mechanical Arrangements

In another embodiment, the present invention protectively surrounds an object. The embodiment comprises a flexible rigid skin encasing a system of porous material, liquid, promoter(s), and optionally one or more recovery agents. The porous materials, liquids, promoters and recovery agents set forth in this document can be used in any appropriate combination. Optionally, the recovery agent can be omitted.

Figure 7:
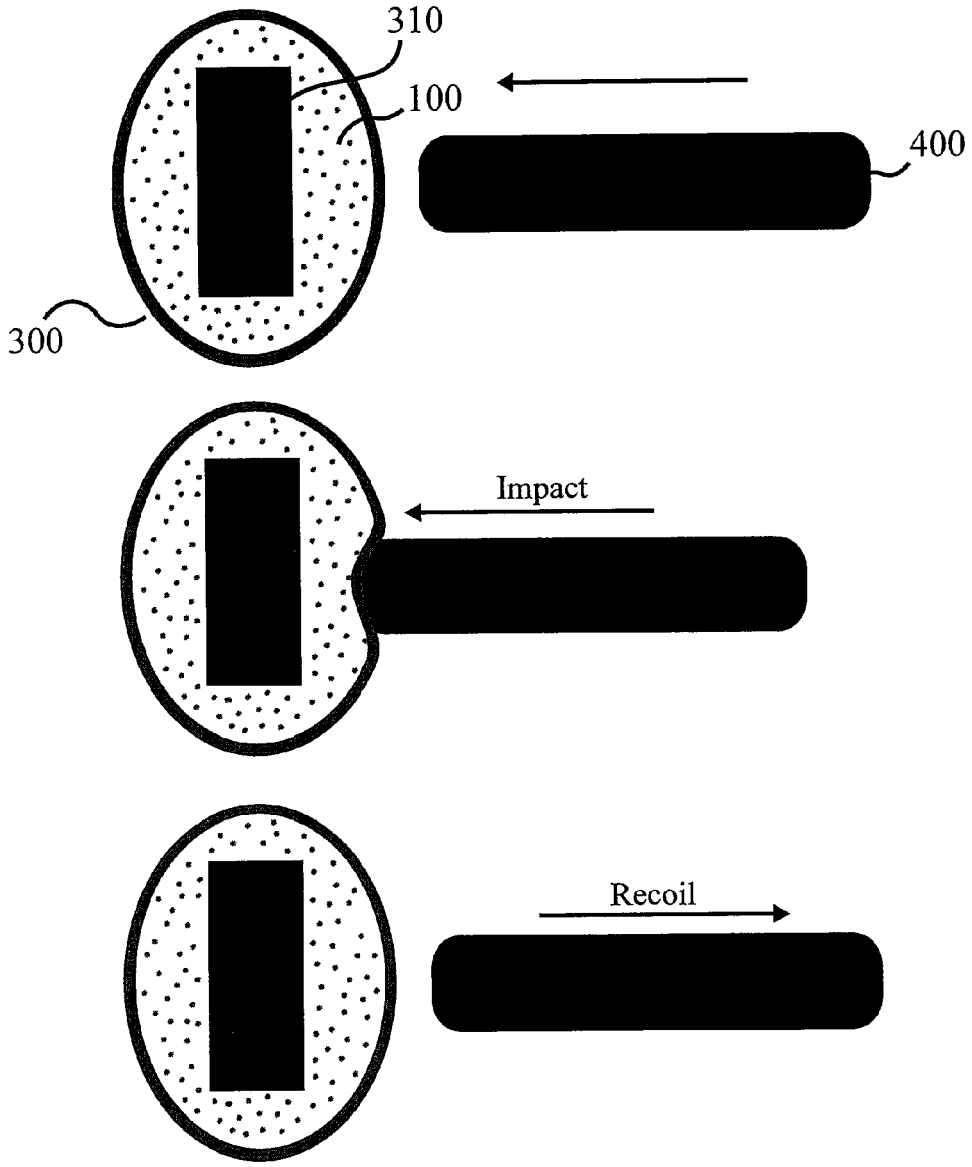
FIG. 7 is a diagram showing an impact and recoil diagram of an encased embodiment with an impacting body.

This embodiment acts as a protective shock absorbing encasement. For instance, the drawing in FIG. 7 shows an object 310 surrounded by the energy absorbing composition 100 of the present invention, which is further encased in a flexible skin 300. When this system is impacted the flexible skin 300 deflects inward compressing the energy absorptive composition 100. If the composition 100 is among the recoverable embodiments then the composition 100 would first compress and then re-expand in the manner of a spring while the object 310 remains unharmed. Alternatively, if the composition 100 is among the non-recoverable embodiments then the system comprising 100 and 300 plastically deforms acting as a sacrificial, i.e. one-time use, energy absorber.

Figure 8:
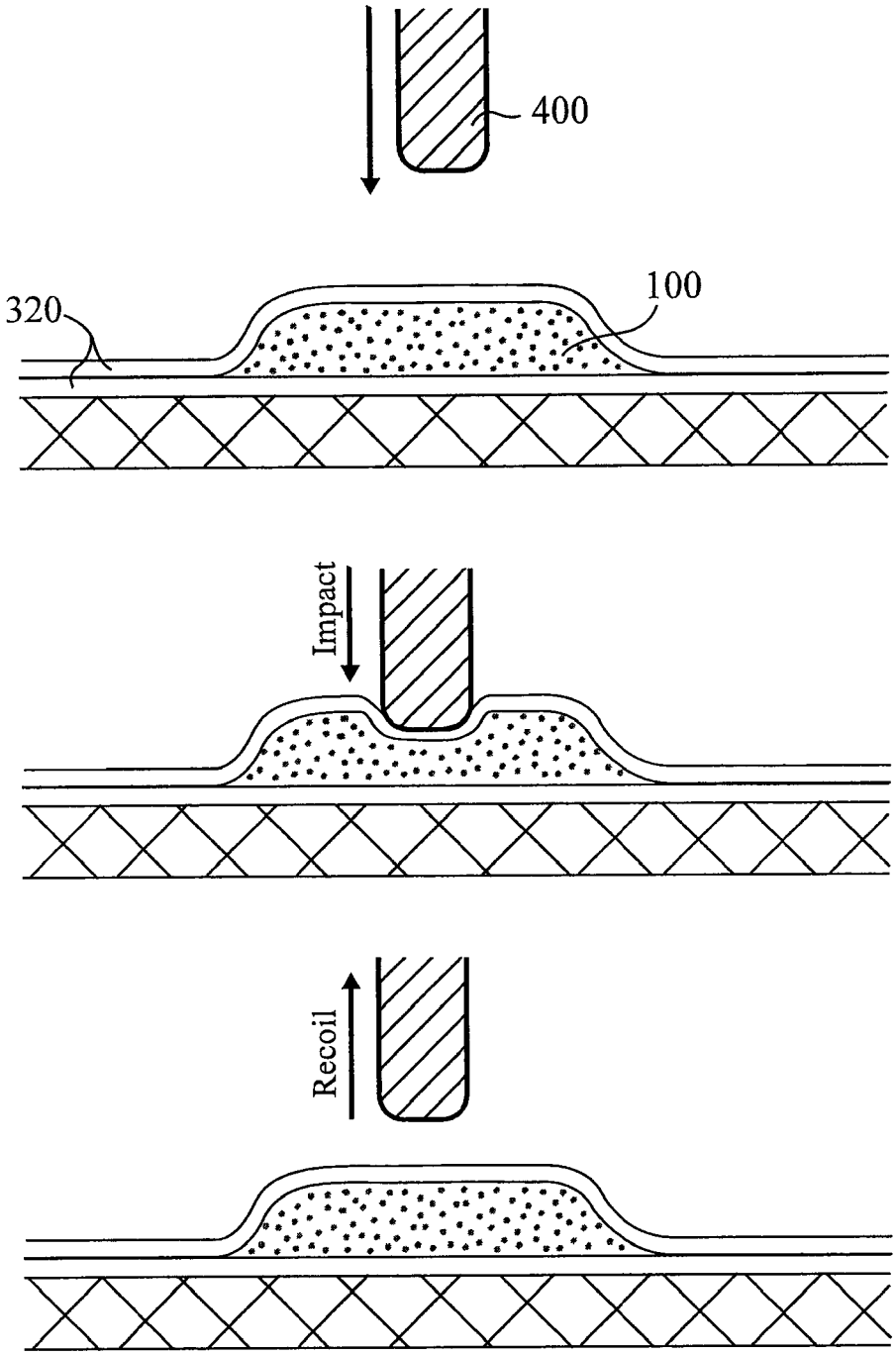
FIG. 8 is a diagram showing an impact and recoil diagram of a padding embodiment with an impacting body, FIG. 9(*a*) is a diagram showing a cross-sectional view of the energy absorbing material encased in a flexible skin having a roughly ellipsoidal shape, FIG. 9(*b*) is a diagram showing a three dimensional view of the energy absorbing material encased in a flexible skin having a roughly ellipsoidal shape, FIG. 10(*a*) is a diagram showing a shock absorbing joint in the context of a suspension bridge, FIG. 10(*b*) is a diagram showing blow-up view of the shock absorbing joint of FIG. 10(*a*), FIG. 10(*c*) is a diagram showing a further blown-up cross sectional view of the shock absorbing element of 10(*b*)

In a further embodiment comprises an energy absorbing pad or bubble. In this embodiment the energy absorbing material 100 is sealed between two sheets of flexible skin 320 as shown in FIG. 8. Here, energy is preferentially absorbed by the energy absorbing composition 100 rather than the body underlying the pad, or the impacting body.

Figure 9:
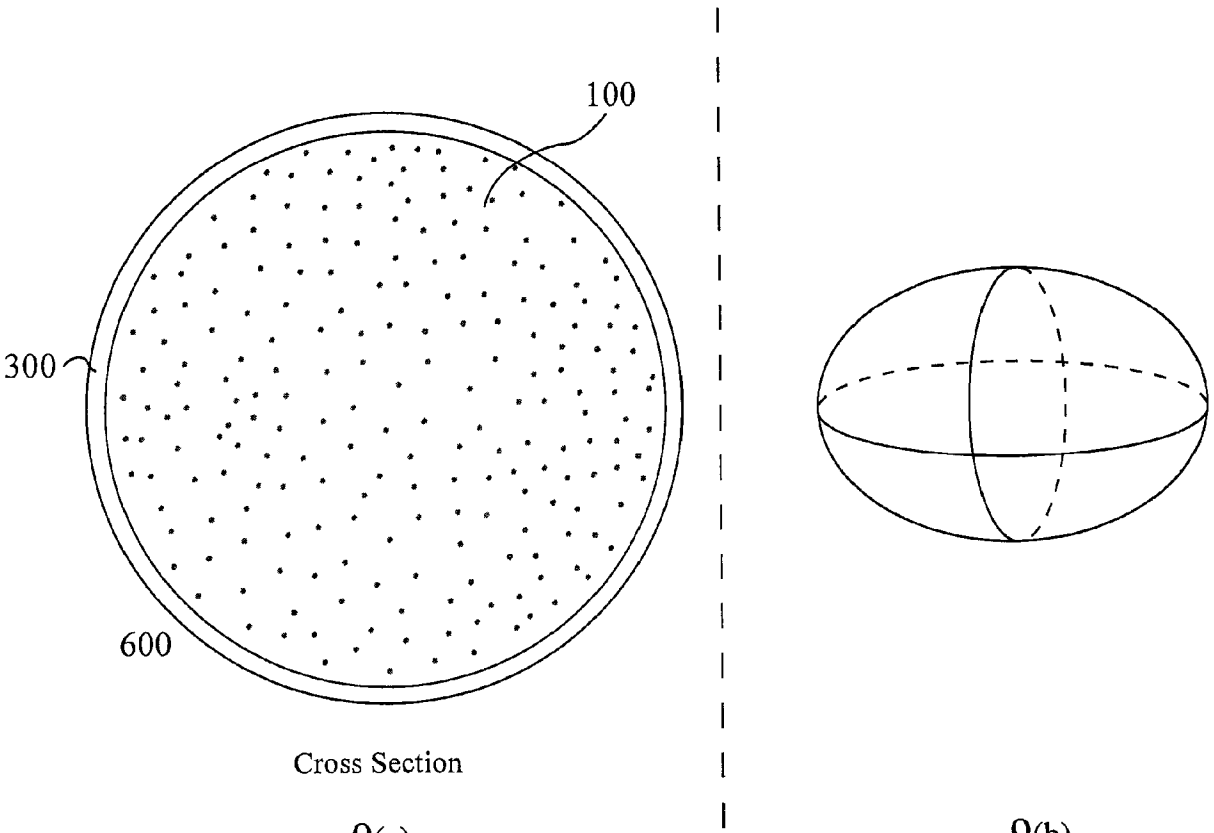
Figure 10:
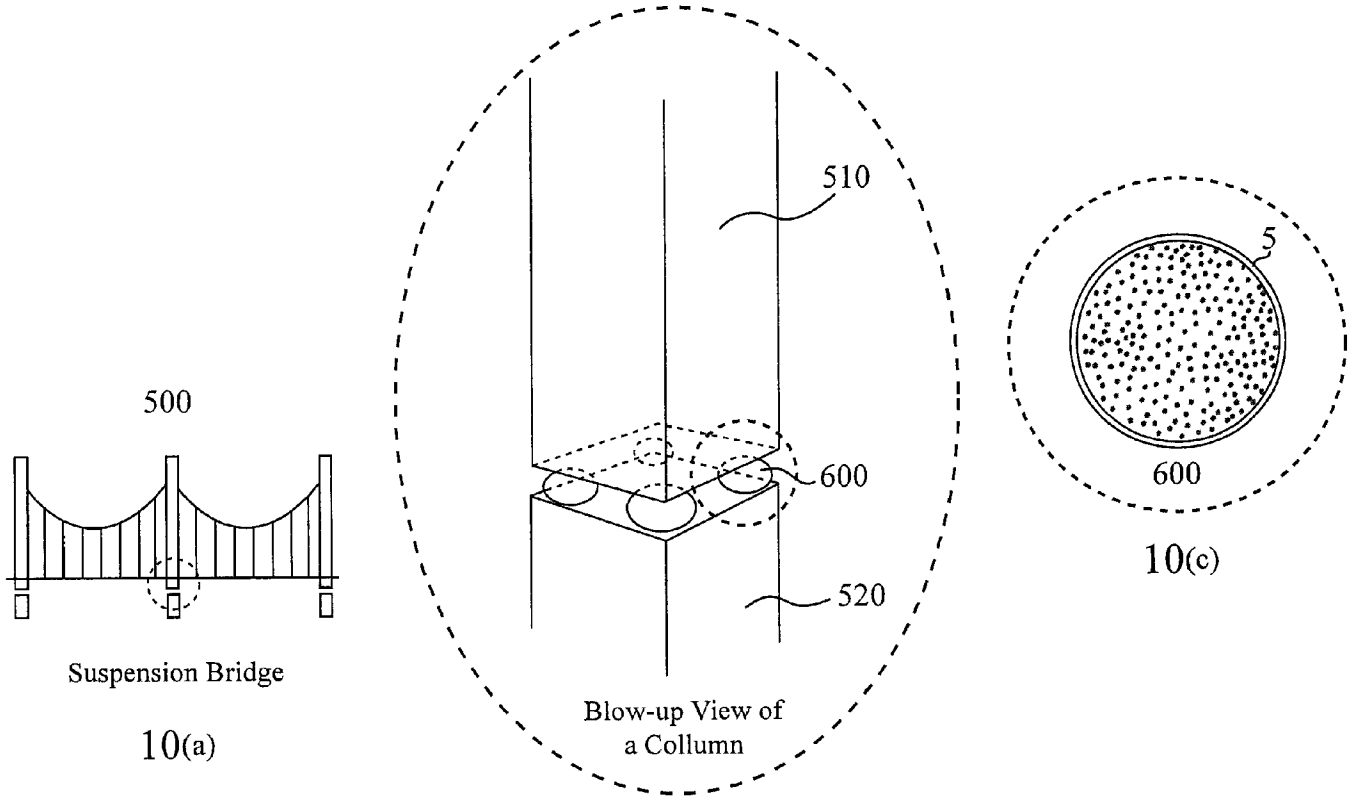

A still further embodiment comprises an energy absorbing sphere or ellipsoid. In this embodiment the energy absorbing material 100 is contained within an arbitrarily shaped flexible skin 300 as shown in FIGS. 9(*a*) and 9(*b*). The system comprising the energy absorbing material 100 and the flexible skin 300 deforms under a load, thus absorbing energy. Furthermore, the deformation can be elastic or plastic depending, in part, on whether one or more optional recovery agents are included. Such an arrangement is be useful in applications requiring elastically deforming ball bearings, or as shock-absorbing springs, as shown in FIG. 10(*a-c*).

Figure 11:
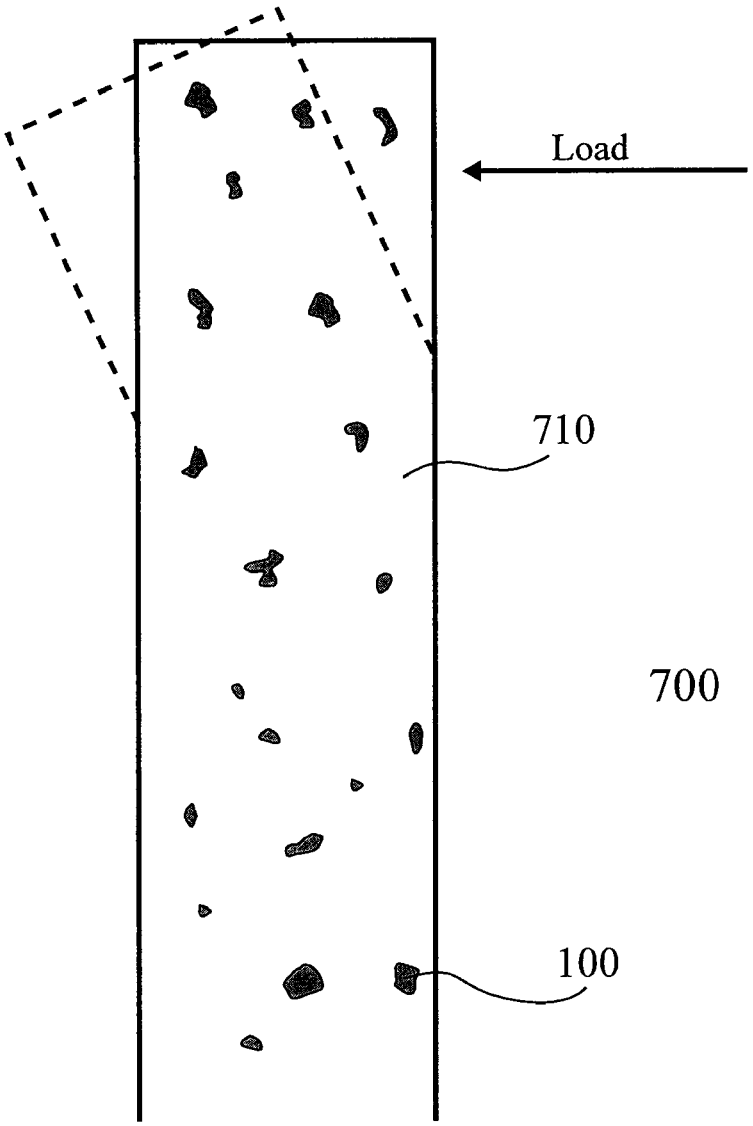
FIG. 11 is a diagram showing a flexible matrix impregnated with the energy absorbing material, with and without a shearing load.
Figure 12:
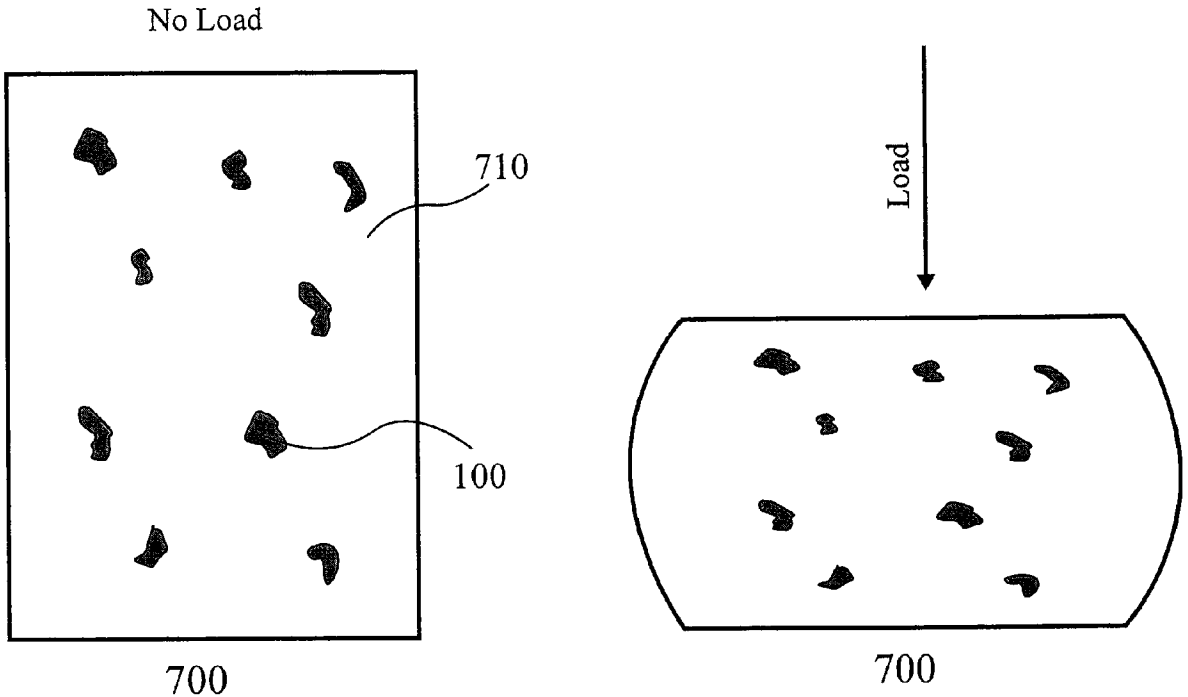
FIG. 12 is a diagram showing a flexible matrix impregnated with the energy absorbing material with and without a compressive load.

Another embodiment comprises a monolithic energy absorbing structure 700 comprising a flexible matrix 710 containing aggregates of energy absorbing material 100. In such a system the aggregates co-absorb energy along with the flexible matrix when the matrix is deformed as shown in FIGS. 11 and 12.

In other embodiments of the present invention the energy absorbing system takes the form of an insole for shoes, a helmet, a motor vehicle's bumper, body armor, a blast resistant container, a blast resistant device, or any device for dispersing impact energy as a means of protecting an object or body.

Various modifications and alterations that do not depart from the scope and spirit of this invention will become apparent to those skilled in the art. This invention is not to be limited to the illustrative embodiments set forth herein.

I claim:

1. An energy absorption system comprising:

a porous material in mechanical communication with a means for communicating a mechanical load, an infiltration liquid, which is non-wetting to the porous material in the absence of a load, wherein the infiltration liquid is in fluid communication with the pores of the porous material, wherein the infiltration liquid includes an additive selected from promoters, recovery agents, and/or viscosity adjusters, wherein the promoters promote the infiltration of the infiltration liquid in to the porous material, the recovery agents enable the system to expel a substantial portion of the infiltration liquid when the load is removed, and the viscosity adjusters adjust the infiltration liquid viscosity; and the means for communicating a mechanical load to the infiltration liquid and porous material so that the infiltration liquid is forced to enter the porous material.

2. The energy absorption system of claim 1, wherein the porous material is selected from zeolites, nanoporous carbons, carbon nanotubes, titanias, aluminas, silicas, CdS, ZnS, aluminum phosphates, gold, nanoporous polyurethane, nanoporous polypyrroles, Kaolins, Serpentines, Smectites, Glauconite, Chlorites, Vermiculites, Attapulgite, Sepiolite, Allophane, Imogolite, and end-capped C.sub.8 reversed phase nanoporous particles having a particle size in the range of 15-35 .mu.m, and any combination thereof.

3. The energy absorption system of claim 1, wherein the infiltration liquid is selected from water, ethanol, propanols, butanols, pentanols, hexanols, heptanols, tetrahydrofuran, glycerin, dimethyl sulfoxide, mineral oils mercury, lithium, gallium, and tin/lead-lithium, glycols, and any combination of two or more thereof.

4. The energy absorption system of claim 1, wherein the promoter is selected from alkyl alcohols, sulfur acids and salts thereof, quaternary amines, alkali metals, alkaline earth metals, polyols, carbohydrates, fats, fatty acids, fatty acid amides, carboxylic acids, fatty acid esters, oils, alkoxylated compounds, silicone surfactants, ethers, and any combination of two or more thereof.

5. The energy absorption system of claim 4, wherein alkyl alcohols are selected from ethanol, methanol, propanols, butanols, pentanols, hexanols, heptanols, and any combination of two or more thereof.

6. The energy absorption system of claim 4, wherein sulfur acids and salts thereof are selected from sulfonates, sulfates, lignosulfonates, hydroxyl-carboxylic acids, sulphonic acids, monoesterified sulphuric acids and any combination of two or more thereof.

7. The energy absorption system of claim 4, wherein quaternary amines are selected from alkylammonium surfactants, alkylammonium salts of alcohols, cetyldimethylethylammonium bromide, benzildimethylalkylammonium chloride, alkylammonium-carboxylates, and any combination of two of more thereof.

8. The energy absorption system of claim 4, wherein carbohydrates are sarcosinates.

9. The energy absorption system of claim 4, wherein polyols are selected from polyethylene glycols, alkylaryl copolymers containing ethylene oxide.

10. The energy absorption system of claim 4, wherein, oils are selected from tallow, coconut oil, palm oil, castor oil, olive oil, citrus oils, and any combination of two or more thereof.

11. The energy absorption system of claim 4, wherein alkoxylated compounds are selected from polyalkoxylated compounds, ethoxylated compounds, polyethoxylated alkylphenols, and any combination of two or more thereof.

12. The energy absorption system of claim 1, wherein the recovery agent is selected from alkyl alcohols, sulfur acids and salts thereof, quaternary amines, alkali metals, alkaline earth metals, polyols, carbohydrates, fats, fatty acids, fatty acid amides, carboxylic acids, fatty acid esters, oils, alkoxylated compounds, silicone surfactants, ethers, and any combination of two or more thereof.

13. The energy absorption system of claim 12, wherein alkyl alcohols are selected from ethanol, methanol, propanols, butanols, pentanols, hexanols, heptanols, and any combination of two or more thereof.

14. The energy absorption system of claim 12, wherein sulfur acids and salts thereof are selected from sulfonates, sulfates, lignosulfonates, hydroxyl-carboxylic acids, sulphonic acids, monoesterified sulphuric acids and any combination of two or more thereof.

15. The energy absorption system of claim 12, wherein quaternary amines are selected from alkylammonium surfactants, alkylammonium salts of alcohols, cetyldimethylethylammonium bromide, benzildimethylalkylammonium chloride, alkylammonium-carboxylates, and any combination of two of more thereof.

16. The energy absorption system of claim 12, wherein carbohydrates are sarcosinates.

17. The energy absorption system of claim 12, wherein polyols are selected from polyethylene glycols, alkylaryl copolymers containing ethylene oxide.

18. The energy absorption system of claim 12, wherein, oils are selected from tallow, coconut oil, palm oil, castor oil, olive oil, citrus oils, and any combination of two or more thereof.

19. The energy absorption system of claim 12, wherein alkoxylated compounds are selected from polyalkoxylated compounds, ethoxylated compounds, polyethoxylated alkylphenols, and any combination of two or more thereof.

20. The energy absorption system of claim 1, wherein the viscosity adjuster is selected from poly(acrylic acid), poly(2-acrylamido-2-methyl-1-propanesulfonic) acid, poly(2-acrylamido-2-methyl-1-propanesulfonic acid-co-acrylonitrile), poly(2-acrylamido-2-methyl-1-propanesulfonic acid-co-styrene), poly(anetholesulfonic acid), poly(sodium 4-styrenesulfonate), poly(styrene-alt-maleic acid), poly(4-styrenesulfonic acid), polyvinyl sulfates, poly(vinylsulfonic acid, sodium salt), quaternized poly(2-vinylpyridines), 4-styrenesulfonic acid salt hydrates, Diallyldimethylammonium chloride, poly(acrylamide-co-diallyldimethylammonium chloride), poly(allylamine hydrochloride), poly (diallyldimethylammonium chloride), manganese hexafluoroacetylacetonate trihydrate, poly(acrylic acid-co-acrylamide), poly(acrylic acid) salt-graft-poly(ethylene oxide), poly(2-hydroxyethyl methacrylate), poly(2-hydroxypropyl methacrylate), poly(isobutylene-co-maleic acid), boric acid salts, chloride salts, sulfate salts, glycerin, glycol, molten salts, and any combination thereof.

21. A method for absorbing impact energy, comprising:

providing a porous material, providing an infiltration liquid, which is non-wetting to the porous material in the absence of a load, wherein the infiltration liquid is in fluid communication with the pores of the porous material, wherein the infiltration liquid includes an additive selected from promoters, recovery agents, and/or viscosity adjusters, wherein the promoters promote the infiltration of the infiltration liquid in to the porous material, the recovery agents enable the system to expel a substantial portion of the infiltration liquid when the load is removed, and the viscosity adjusters adjust the infiltration liquid viscosity;

providing a means for communicating a compressive load to the infiltration liquid and porous material so that the infiltration liquid is forced to enter the porous material; and impacting the means for communicating a compressive load with a projectile, a self-propelled body, or a shock wave, wherein the impact is capable of actuating the means for communicating a compressive load.

22. The method for absorbing impact energy of claim 21, wherein the porous material is selected from zeolites, nanoporous carbons, carbon nanotubes, titanias, aluminas, silicas, CdS, ZnS, aluminum phosphates, gold, nanoporous polyurethane, nanoporous polypyrroles, Kaolins, Serpentines, Smectites, Glauconite, Chlorites, Vermiculites, Attapulgite, Sepiolite, Allophane Imogolite, and end-capped C.sub.8 reversed phase nanoporous particles having a particle size in the range of 15-35 .mu.m, and any combination thereof.

23. The method for absorbing impact energy of claim 21, wherein the infiltration liquid is selected from water, ethanol, propanols, butanols, pentanols, hexanols, heptanols, tetrahydrofuran, glycerin, dimethyl sulfoxide, mineral oils mercury, lithium, gallium, tin/lead-lithium, and any combination of two or more thereof.

24. The method for absorbing impact energy of claim 21, wherein the promoter is selected from alkyl alcohols, sulfur acids and salts thereof, quaternary amines, alkali metals, alkaline earth metals, polyols, carbohydrates, fats, fatty acids, fatty acid amides, carboxylic acids, fatty acid esters, oils, alkoxylated compounds, silicone surfactants, ethers, and any combination of two or more thereof.

25. The method for absorbing impact energy of claim 24, wherein alkyl alcohols are selected from ethanol, methanol, propanols, butanols, pentanols, hexanols, heptanols, and any combination of two or more thereof.

26. The method for absorbing impact energy of claim 24, wherein sulfur acids and salts thereof are selected from sulfonates, sulfates, lignosulfonates, hydroxyl-carboxylic acids, sulphonic acids, monoesterified sulphuric acids and any combination of two or more thereof.

27. The method for absorbing impact energy of claim 24, wherein quaternary amines are selected from alkylammonium surfactants, alkylammonium salts of alcohols, cetyldimethylethylammonium bromide, benzildimethylalkylammonium chloride, alkylammonium-carboxylates, and any combination of two of more thereof.

28. The method for absorbing impact energy of claim 24, wherein carbohydrates are sarcosinates.

29. The method for absorbing impact energy of claim 24, wherein polyols are selected from polyethylene glycols, alkylaryl copolymers containing ethylene oxide.

30. The method for absorbing impact energy of claim 24, wherein, oils are selected from tallow, coconut oil, palm oil, castor oil, olive oil, citrus oils, and any combination of two or more thereof.

31. The method for absorbing impact energy of claim 24, wherein alkoxylated compounds are selected from polyalkoxylated compounds, ethoxylated compounds, polyethoxylated alkylphenols, and any combination of two or more thereof.

32. The method for absorbing impact energy of claim 21, wherein the recovery agent is selected from alkyl alcohols, sulfur acids and salts thereof, quaternary amines, alkali metals, alkaline earth metals, polyols, carbohydrates, fats, fatty acids, fatty acid amides, carboxylic acids, fatty acid esters, oils, alkoxylated compounds, silicone surfactants, ethers, and any combination of two or more thereof.

33. The method for absorbing impact energy of claim 32, wherein alkyl alcohols are selected from ethanol, methanol, propanols, butanols, pentanols, hexanols, heptanols, and any combination of two or more thereof.

34. The method for absorbing impact energy of claim 32, wherein sulfur acids and salts thereof are selected from sulfonates, sulfates, lignosulfonates, hydroxyl-carboxylic acids, sulphonic acids, monoesterified sulphuric acids and any combination of two or more thereof.

35. The method for absorbing impact energy of claim 32, wherein quaternary amines are selected from alkylammonium surfactants, alkylammonium salts of alcohols, cetyldimethylethylammonium bromide, benzildimethylalkylammonium chloride, alkylammonium-carboxylates, and any combination of two of more thereof.

36. The method for absorbing impact energy of claim 32, wherein carbohydrates are sarcosinates.

37. The energy absorption system of claim 32, wherein polyols are selected from polyethylene glycols, alkylaryl copolymers containing ethylene oxide.

38. The method for absorbing impact energy of claim 32, wherein, oils are selected from tallow, coconut oil, palm oil, castor oil, olive oil, citrus oils, and any combination of two or more thereof.

39. The method for absorbing impact energy of claim 32, wherein alkoxylated compounds are selected from polyalkoxylated compounds, ethoxylated compounds, polyethoxylated alkylphenols, and any combination of two or more thereof.

40. The method for absorbing impact energy of claim 21, wherein the viscosity-adjusting additive is selected from poly (acrylic acid), poly(2-acrylamido-2-methyl-1-propanesulfonic) acid, poly(2-acrylamido-2-methyl-1-propanesulfonic acid-co-acrylonitrile), poly(2-acrylamido-2-methyl-1-propanesulfonic acid-co-styrene), poly(anetholesulfonic acid), poly(sodium 4-styrenesulfonate), poly(styrene-alt-maleic acid), poly(4-styrenesulfonic acid), polyvinyl sulfates, poly(vinylsulfonic acid, sodium salt), quaternized poly(2-vinylpyridines), 4-styrenesulfonic acid salt hydrates, Diallyldimethylammonium chloride, poly(acrylamide-co-diallyldimethylammonium chloride), poly(allylamine hydrochloride), poly(diallyldimethylammonium chloride), manganese hexafluoroacetylacetonate trihydrate, poly (acrylic acid-co-acrylamide), poly(acrylic acid) salt-graft-poly(ethylene oxide), poly(2-hydroxyethyl methacrylate), poly(2-hydroxypropyl methacrylate), poly(isobutylene-co-maleic acid), boric acid salts, chloride salts, sulfate salts, glycerin, glycol, molten salts, and any combination of two or more thereof.

41. An energy absorption system comprising:

at least one infiltration liquid, wherein the infiltration liquid includes an additive selected from promoters, recovery agents, and/or viscosity adjusters, wherein the promoters promote the infiltration of the infiltration liquid in to a porous material, the recovery agents enable the system to expel a substantial portion of the infiltration liquid when the load is removed, and the viscosity adjusters adjust the infiltration liquid viscosity;

the porous material having at least one pore therein, the one or more pores of the porous material being in fluid communication with at least one infiltration liquid;

a containment means designed to contain the porous material and the at least one infiltration liquid; and a means for communicating mechanical energy to either one or both of the porous material and the at least one infiltration liquid such that at least a portion of the at least one infiltration liquid enters the one or more pores of the porous material under the influence of mechanical energy, and wherein the at least one infiltration liquid is non-wetting to the porous material in the absence of mechanical energy.

* * * * *